US006973272B2

(12) United States Patent
Yamamoto et al.

(10) Patent No.: US 6,973,272 B2
(45) Date of Patent: Dec. 6, 2005

(54) IMAGE FORMING APPARATUS AND METHOD

(75) Inventors: Keiji Yamamoto, Ebina (JP); Ryo Ando, Ebina (JP); Toshiyuki Kazama, Ebina (JP); Satoru Torimaru, Ebina (JP); Takashi Kawabata, Ebina (JP); Katsunori Kikuchihara, Ebina (JP); Masaaki Takahashi, Ebina (JP); Yoko Miyamoto, Ebina (JP); Satoshi Matsuzaka, Ebina (JP); Kiyotoshi Kaneyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 45 days.

(21) Appl. No.: 10/682,025

(22) Filed: Oct. 10, 2003

(65) Prior Publication Data

US 2004/0175196 A1 Sep. 9, 2004

(30) Foreign Application Priority Data

Mar. 6, 2003 (JP) ..... 2003-060497

(51) Int. Cl.[7] ..... G03G 15/00
(52) U.S. Cl. ..... 399/15; 347/116; 399/49; 399/72; 399/301
(58) Field of Search ..... 399/15, 49, 72, 399/46, 45, 9, 301, 394, 395; 358/504, 406; 382/112, 317; 347/19, 116

(56) References Cited

U.S. PATENT DOCUMENTS

| | | | | |
|---|---|---|---|---|
| 5,576,811 | A * | 11/1996 | Kobayashi et al. | 399/15 X |
| 5,742,867 | A * | 4/1998 | Kodama | 399/49 |
| 5,887,223 | A * | 3/1999 | Sakai et al. | 399/15 X |
| 6,148,168 | A * | 11/2000 | Hirai et al. | 399/301 |
| 6,151,460 | A * | 11/2000 | Sawaki | 399/15 X |
| 6,243,542 | B1 * | 6/2001 | Fujimoto et al. | 399/49 |
| 6,490,421 | B2 * | 12/2002 | McIntyre | 399/15 |
| 6,563,524 | B1 * | 5/2003 | Regimbal et al. | 347/116 |
| 6,687,471 | B2 * | 2/2004 | Sakata et al. | 399/49 |
| 6,763,199 | B2 * | 7/2004 | Conrow et al. | 399/15 |
| 2003/0175602 | A1 * | 9/2003 | Kazama | 399/9 X |
| 2004/0085378 | A1 * | 5/2004 | Sievert et al. | 347/19 |

FOREIGN PATENT DOCUMENTS

| | | | |
|---|---|---|---|
| JP | 8-115011 | | 5/1996 |
| JP | 2001-022141 | A * | 1/2001 |

* cited by examiner

*Primary Examiner*—Sophia S. Chen
(74) *Attorney, Agent, or Firm*—Morgan Lewis & Bockius LLP

(57) ABSTRACT

The present invention enables registration adjustments during actual use of an image forming apparatus. A test pattern is formed on a sheet in a full-color image forming apparatus and the test pattern formed on the sheet is read in an image read unit. From the result of reading the test pattern, misregistrations of vertical and horizontal scaling factors, parallelism, squareness, skew, side registration, and lead registration in the test pattern are determined, and mounting positions, drive timings, drive speeds, and the like of constituent members are adjusted.

14 Claims, 12 Drawing Sheets

IMAGE FORMING APPARATUS AND METHOD

BACKGROUND OF THE INVENTION

1. Field of the Invention

The present invention relates to an image forming apparatus such as an electrophotographic copier and a laser printer and a method thereof, and more particularly to an image forming apparatus and method suitable for forming images with high precision.

2. Description of Related Art

In recent years, image forming apparatuses such as printers, copiers, and facsimiles are proposed to be of full-color, tandem type to form color images at high speed and with high quality. A typical tandem image forming apparatus includes one in which four image forming units for yellow (Y), magenta (M), cyan (C), and black (K) disposed in parallel to each other in which toner images of yellow, magenta, cyan, and black are successively formed, the toner images are transferred (primary transfer) onto an intermediate transfer belt serving as an intermediate transfer member, then the toner images are collectively transferred (secondary transfer) from the intermediate transfer belt onto a transfer sheet, and the toner images formed on the transfer sheet are fixed, thereby forming full-color and black-and-white (monochromatic) images.

To obtain high-quality images in such an image forming apparatus requires a high degree of registration capabilities, more specifically, e.g., the capability of registration of the toner images of different colors superimposed on the intermediate transfer belt, and the capability of registration of the transfer sheet onto which the toner images on the intermediate transfer belt are to be transferred. In Patent Reference 1, for example, technology is disclosed which sets image formation positions for transfer sheets housed in trays for each of the trays.

[Patent Reference 1]

Japanese Published Unexamined Patent Application No. Hei 8-115011 (Page 1)

By the way, recent image forming apparatuses are demanded to have as high precision as offset presses, as well as a higher level of registration capability.

However, although a conventional image forming apparatus has allowed confirmation of simplified registration capability by folding a transfer sheet on which a test pattern is printed using the image forming apparatus, it has had difficulty in confirmation of high-precision registration capability and adjustment of registration capability by users.

SUMMARY OF THE INVENTION

The present invention has been made to solve the above-described technical problems and provides an image forming apparatus capable of adjustment of registration during actual use thereof.

Further, the present invention forms images with high precision regardless of different recording materials and environment conditions.

The present invention proposes adjusting use conditions of members (image forming members) used for image formation on the basis of the result of reading an image created by itself.

More specifically, an image forming apparatus of the present invention includes: an image forming part that forms an image in a recording material; a read part that reads an image formed in the recording material by the image forming part; and an adjusting part that adjusts use conditions of image forming members used in the image forming part on the basis of image data read by the read part. In the present invention, the image forming members conceptually include different members used in image formation operations, and the use conditions of the image forming members conceptually include mounting positions of the image forming members as well as, if the image forming members are driven (rotation, rocking, movement, and the like), drive timings, drive speeds, and the like thereof.

In the present invention, the adjusting part adjusts the use conditions of the image forming members exerting an influence on at least one of image vertical and horizontal scaling factors, parallelism, squareness, lead registration, side registration, and side skew. The adjusting part determines image misregistration values on the basis of the image data obtained by the read part, and, if the obtained misregistration values are larger than predetermined specification values, adjusts the use conditions of the image forming members. The image forming apparatus further includes a storing part in which the use conditions of the image forming members that were used for adjustments by the adjusting part are stored. Further, the storing part stores the use conditions of the image forming members for each of types of recording materials used. Further, the storing part stores the use conditions of the image forming members for each of environments in which a recording material of an identical type is used.

The image forming part forms images on both sides of the recording material, the read part reads the images formed on the both sides of the recording material by the image forming part, and the adjusting part adjusts the use conditions of the image forming members used in the image forming part on the basis of the image data read by the read part, for each side of the recording material.

From other standpoints, the image forming apparatus of the present invention includes: an image forming part that forms an image in a recording material; a read part that reads an image formed in the recording material by the image forming part; and an indicating part that indicates adjustments on use conditions of image forming members used in the image forming part on the basis of image data read by the read part. The image forming members and the use conditions of the image forming members are the same as those described above.

The image forming apparatus of the present invention further includes a display part in which adjustment indications on the use conditions of the image forming members by the indicating part are displayed, and on the basis of adjustment indications displayed in the display part, the use conditions of the image forming members are adjusted.

BRIEF DESCRIPTION OF THE DRAWINGS

A preferred embodiment of the present invention will be described in detail on the basis of the followings, wherein.

DESCRIPTION OF THE PREFERRED EMBODIMENTS

Hereinafter, embodiments of the present invention will be described in detail with reference to the accompanying drawings.

Figure 1:
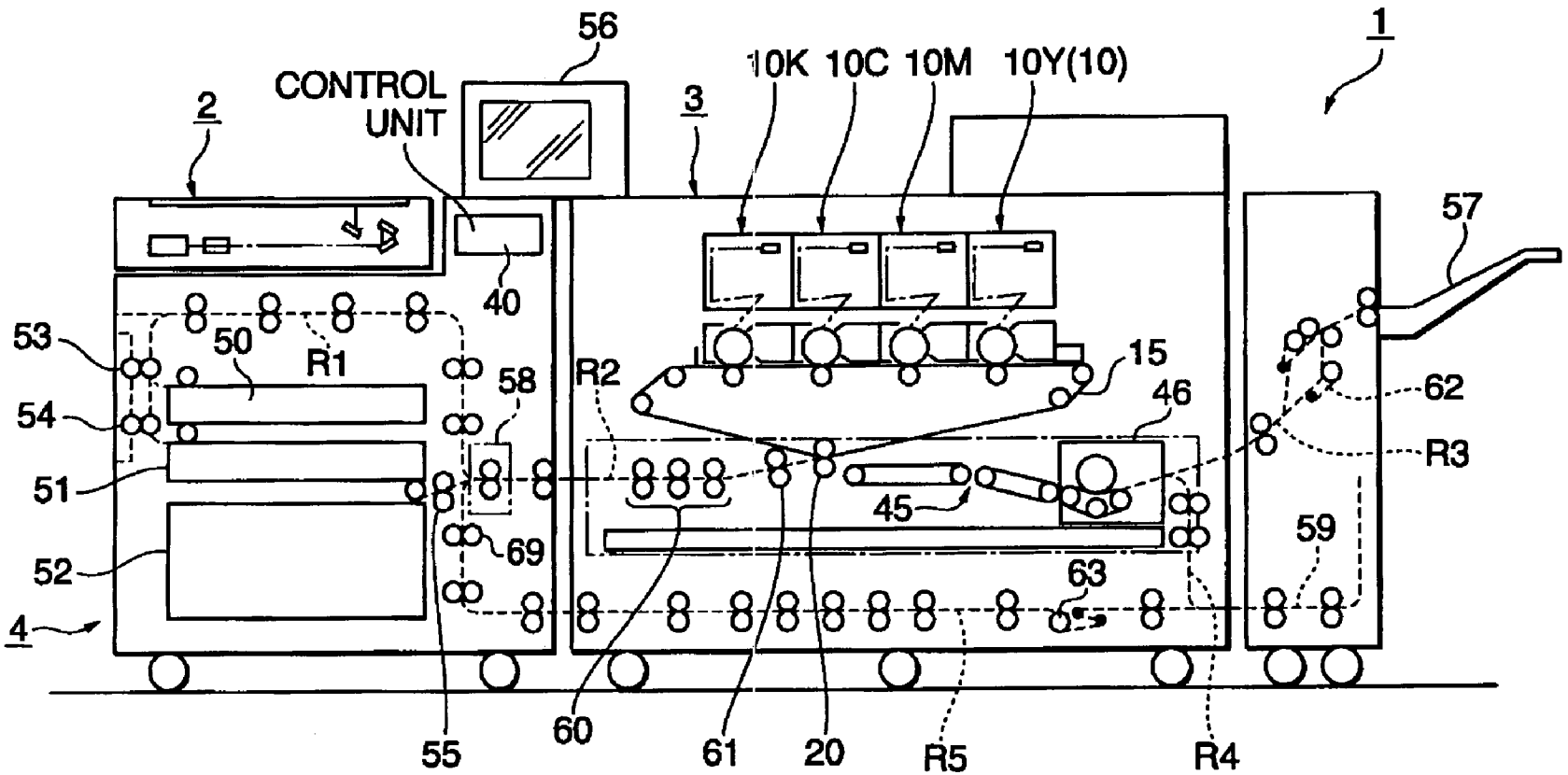
FIG. 1 is a schematic diagram showing an overall configuration of a full-color image forming apparatus of the embodiment.
Figure 2:
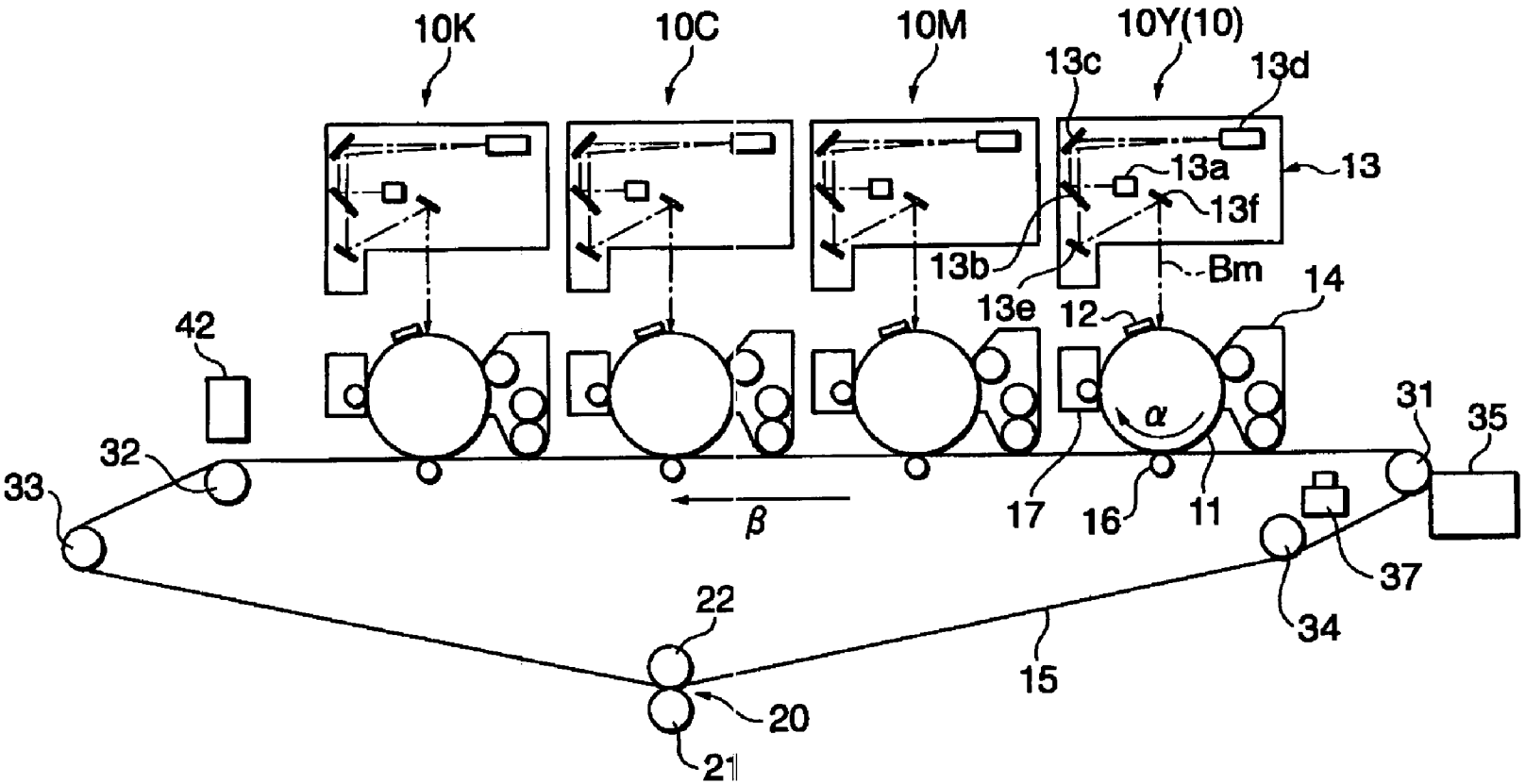
FIG. 2 is a diagram showing main portions of the full-color image forming apparatus of the embodiment.

FIG. 1 is a schematic diagram showing an overall configuration of a full-color image forming apparatus 1 of an embodiment. FIG. 2 is a magnified view of its main portions. The full-color image forming apparatus 1, which is a so-called tandem image forming apparatus of so-called intermediate transfer technique, primarily includes: an image read unit 2 that reads an image of an original; an image forming unit 3 that forms an image on a sheet; and a sheet feeding unit 4 that feeds the sheet to the image forming unit 3.

In this embodiment, the image read unit 2 reads an image of an original set on a transparent original base. It includes: an optical scanning system having, e.g., a lamp, mirror, carriage, and the like; a lens system for forming an optical image scanned by the optical scanning system; and an image read sensor such as CCD that receives the optical image formed by the lens system and converts it into an electric signal.

The image forming unit 3 includes: plural image forming units 10 (10Y, 10M, 10C, 10K) that form toner images of different color components by electrophotography; an intermediate transfer belt 15 that successively transfers (primary transfer) and holds toner images of different color components formed in the image forming units 10; a secondary transfer unit 20 that collectively transfers (secondary transfer) superimposed toner images transferred onto the intermediate transfer belt 15 to a sheet, which is a recording material (transfer material); and a fixing unit 46 that fixes the images subjected to the secondary transfer on the sheet. A control unit 40 controls the operation of the units.

In this embodiment, the image forming units 10 (10Y, 10M, 10C, 10K) are, in the periphery of photoconductive drums 11 rotating in the direction of the arrow a, disposed with electrophotographic devices such as: electrifiers 12 that electrify the photoconductive drums 11; laser exposing units 13 that write static latent images onto the photoconductive drums 11 (in the drawing, an exposure beam is indicated by symbol Bm); developing apparatuses 14 in which toners of different color components are housed and which visualize static latent images on the photoconductive drums 11 by the toners; primary transfer roles 16 that transfer toner images of different color components formed on the photoconductive drums to the intermediate transfer belt 15; and drum cleaners 17 that removes residual toner on the photoconductive drums. These image forming units 10 are substantially linearly disposed in the order of yellow (Y color), magenta (M color), cyan (C color), and black (K color) from the upstream side of the intermediate transfer belt 15. These laser exposing units 13 each include: a laser diode 13*a* that emits laser light; a polygon mirror 13*d* that raster-scans laser light irradiated via the mirrors 13*b* and 13*c*; and mirrors 13*e* and 13*f* that guide laser light reflected from the polygon mirror 13*d* to the photoconductive drums 11 via the mirror 13*c*. Of these, the mirror 13*f* is formed as a skew mirror whose mounting angles can be finely adjusted by a mirror drive motor 112 described later (see FIG. 6 described later). The laser diode 13*a* is driven by an LD drive apparatus 118. (see FIG. 6 described later).

The intermediate transfer belt 15 is made of resin such as polyimide or polyamide containing a proper amount of conductive agent such as carbon black, and is formed to have a volume resistivity of $10^6$ to $10^{14}$. It is a filmy endless belt of, e.g., about 0.1 mm in thickness. The intermediate transfer belt 15 is cyclically driven (rotated) at a predetermined speed in the β direction shown in the drawing by various types of rolls. The various types of rolls include: a drive roll 31 that is driven by a belt drive motor 113 (see FIG. 6 described later) having a constant speed and cyclically drives the intermediate transfer belt 15; a support roll 32 that supports the intermediate transfer belt 15 extending substantially linearly along the arrangement direction of the photoconductive drums 11; a tension roll 33 that applies a fixed amount of tension to the intermediate transfer belt 15 and functions as a correction roll for preventing the meandering of the intermediate transfer belt 15; a backup roll 22 provided in the secondary transfer unit 20; and an idle roll 34 provided in the downstream side of the transportation direction of the intermediate transfer belt 15 with respect to the secondary transfer unit 20.

The primary rolls 16 that face the photoconductive drums 11 and are provided inside the intermediate transfer belt 15 are applied with voltages of the reversed polarity (positive polarity in this embodiment) of the electrification polarity of toner. As a result, toner images on the photoconductive drums 11 are successively electrostatically attracted to the intermediate transfer belt 15 and superimposed toner images are formed on the intermediate transfer belt 15.

The secondary transfer unit 20 includes: a secondary transfer roll 21 disposed in the toner image holding side of the intermediate transfer belt 15; and the backup roll 22. The backup roll 22 has a tube of blend rubber of EPDM and NBR surficially dispersed with carbon, its inside being made of EPDM rubber, and is formed to have a surface resistivity of 7 to 10 log ohms/quadrature, a roll diameter of 28 mm, and a hardness of, e.g., 70 degrees (ASCOR C). The backup roll 22, which is disposed on the back of the intermediate transfer belt 15, serves as an opposite electrode of the secondary transfer roll 21, and a metallic feeding roll (not shown) to which secondary transfer bias is stably applied is disposed so that it abuts against the backup roll 22.

In the downstream side of the intermediate transfer belt 15 with respect to the secondary transfer unit 20, a belt cleaner 35 is disposed opposite to the drive roll 31 across the intermediate transfer belt 15 and disposed opposite to the intermediate transfer belt 15. The belt cleaner 35 eliminates residual toner and sheet particles on the intermediate transfer belt 15 after secondary transfer to clean the surface of the intermediate transfer belt 15. On the other hand, in the upstream side of the image forming unit 10Y for yellow, a reference sensor (home position sensor) 37 is disposed to generate a reference signal for providing image formation timing for the image forming units 10 (10Y, 10M, 10C, 10K). In the downstream side of the image forming unit 10K for black, an image density sensor 42 for image quality adjustment is disposed. The reference sensor 37 generates the reference signal upon recognition of predetermined marks provided on the back of the intermediate transfer belt 15, and according to an indication from the control unit 40 on the basis of the reference signal, the image forming units 10 (10Y, 10M, 10C, 10K) start image formation.

In the downstream side of the secondary transfer unit 20, a vacuum transportation unit 45 is provided that transports the sheet having been subjected to secondary transfer while attracting it. The vacuum transportation unit 45 attracts and transports the sheet to which toner images have been transferred by the secondary transfer roll 21, to the fixing unit 46. The fixing unit 46 fixes the toner images by heating and pressing.

The sheet feeding unit 4 transports sheets (not shown) respectively housed in a first tray 50, a second tray 51, and a third tray 52 through corresponding routes. In the vicinity of the trays 50 to 52 are disposed feeding rolls 53, 54, and 55 corresponding to them. The feeding rolls 53 to 55 nip sheets taken out one at a time in a separated form from corresponding trays 50 to 52 and temporarily halt them on sheet transportation paths, and at a timing based on a predetermined start signal, feed them to the downstream side of sheet transportation direction. In the vicinity of the image read unit 2 is provided an operation panel 56 operated by users.

Transportation rolls are disposed in proper positions of sheet transportation paths R1 to R5 extending to a discharge tray 57 via image formation processing positions of the image forming unit 3 from sheet feed positions of the feeding rolls 53 to 55. A sheet housed in the first tray 50 is fed by the feeding roll 53, then fed to a junction transportation unit 58 via the first sheet transportation path R1. A sheet housed in the second tray 51 is fed by the feeding roll 54, then fed to the junction transportation unit 58 via the first sheet transportation path R1. On the other hand, a sheet housed in the third tray 52 is directly fed to the junction transportation unit 58 by the feeding roll 55.

The sheet fed to the junction transportation unit 58 is fed to the secondary transfer unit 20 of the image forming unit 3 via a second sheet transportation path R2. Further, the sheet passing through the secondary transfer unit 20 is fed to the fixing unit 46 by the vacuum transportation unit 45, then discharged to the discharge tray 57 via the third sheet transportation path R3. In contrast, a sheet on the both sides of which images are formed passes through the fixing unit 46, then fed to a double side reversion unit 59 via a fourth sheet transportation path R4, where the sides of the sheet are reversed, and fed back to the junction transportation unit 58 via a fifth sheet transportation path R5.

In the sheet transportation paths R1 to R5, a posture correction unit 60 and a registration roll 61 are disposed in the second sheet transportation path R2. The posture correction unit 60 corrects the posture of sheet transported through the second sheet transportation path R2. The registration roll 61 has a pair of rolls held in close contact with each other, and feeds the sheet to the secondary transfer unit 20 by rotating the roll pair at a timing based on a predetermined start signal while nipping the sheet between the pair of rolls. The posture correction unit 60 and the registration roll 61 will be described in detail later. The sheet transportation paths R3 and R5 are respectively provided with curl correction units 62 and 63 for correcting curl produced during fixing in the fixing unit 46.

The operation of the tandem full-color image forming apparatus 1 of this embodiment will be described. When the image of an original is read by the image read unit 2, toner images are formed on the basis of an image signal obtained by the reading. In the image forming unit 3, while the four photoconductive drums 11 are being rotated, toner images of yellow, magenta, cyan, and black are formed on the surfaces of the photoconductive drums 11 by electrifiers 12, laser exposing units 13, and developing apparatuses 14 corresponding to the photoconductive drums 11. The toner images of the different colors thus formed are successively transferred and superimposed on the intermediate transfer belt 15 by the primary transfer roles 16. As a result, multiple-color (full-color) toner images with the four toner images overlapped are formed on the intermediate transfer belt 15. The toner images formed on the intermediate transfer belt 15 are fed to the secondary transfer unit 20 while being held on the intermediate transfer belt 15.

On the other hand, a sheet of a tray selected by a user using the operation panel 56 or sheet selected by an automatic selection function is fed to the registration roll 61 in step with timing in which the toner images on the intermediate transfer belt 15 arrive in the secondary transfer unit 20. For example, if the selected tray is the first tray 50, sheet fed by the feeding roll 53 is fed to the junction transportation unit 58 via the first sheet transportation path R1, further corrected for its posture in the posture correction unit 60 via the second sheet transportation path R2, and then fed to the secondary transfer unit 20 by the registration roll 61.

In the secondary transfer unit 20 of the image forming unit 3, the toner images (full-color images) held on the intermediate transfer belt 15 are collectively transferred (secondary transfer) to the sheet by the secondary transfer roll 21. Thereafter, the sheet to which the toner images have been transferred is fed to the fixing unit 46 by the vacuum transportation unit 45, fixed by heating and pressing, and then discharged to the discharge tray 57 via the third sheet transportation path R3.

In cases where images are formed on both sides of a sheet, a sheet with images formed on a single side is fed to the double side reversion unit 59, where the sides of the sheet are reversed, and fed to the fifth sheet transportation path R5. Thereafter, the sheet with images formed on a single side is transported along the fifth sheet transportation path R5 and temporarily stops upon collision with a feeding roll 69 provided in the vicinity of the end of the fifth sheet transportation path R5. Rotation of the feeding roll 69, triggered by a predetermined restart signal, causes the sheet with images formed on a single side to be fed again to the junction transportation unit 58 after timing adjustment, Subsequently, in the same way, toner images are transferred to the sheet and fixed, and then discharged to the discharge tray 57 via the third sheet transportation path R3.

The full-color image forming apparatus 1 of this embodiment has a function for setting conditions (use conditions) on mounting positions (alignment), drive timings, or drive speeds of different constituent members (image forming members) disposed within the image forming unit 3 on the basis of environments in which the full-color image forming apparatus 1 is used, the types of sheet used in the full-color image forming apparatus 1, and the like.

Figure 3:
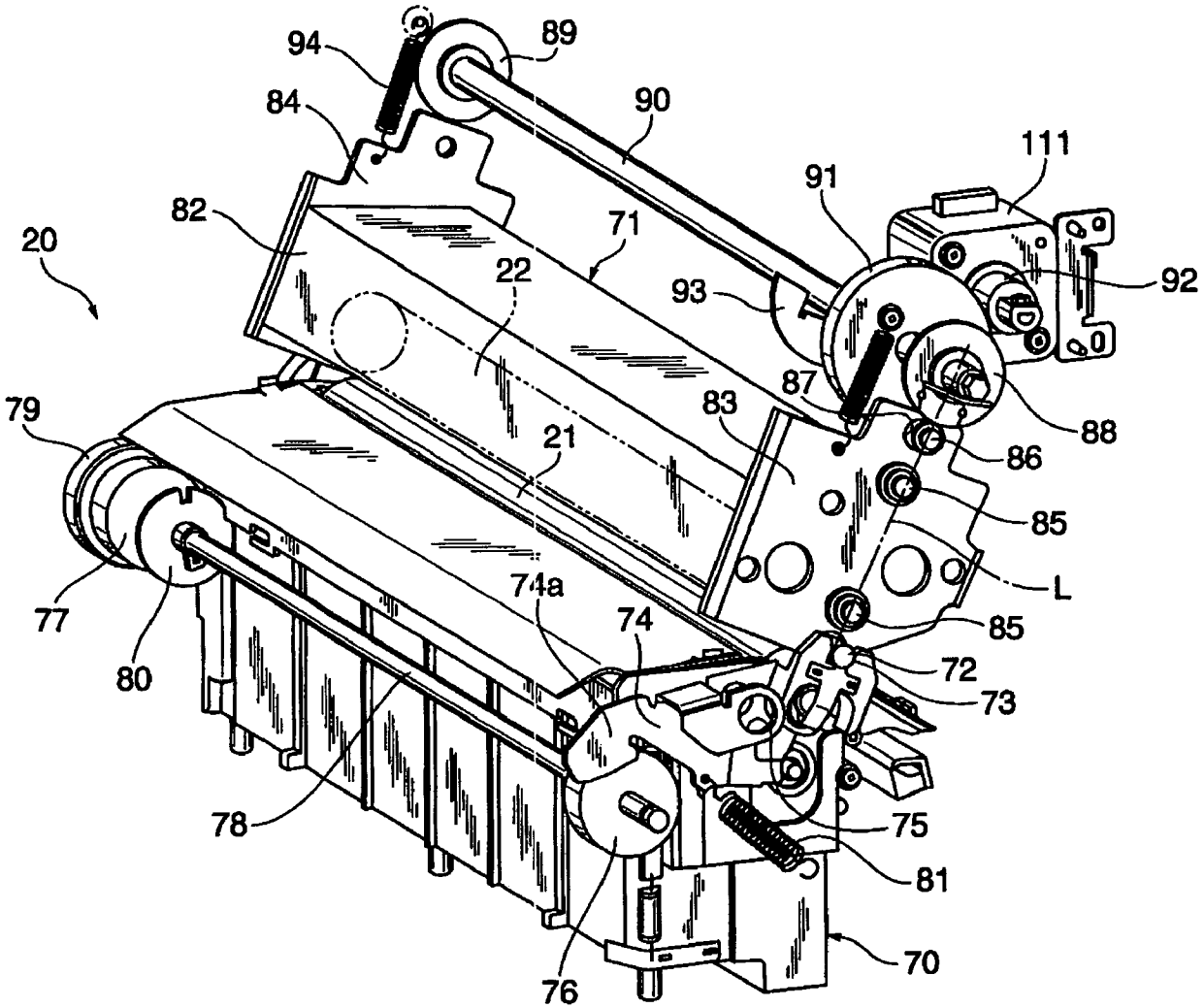
FIG. 3 is a perspective view showing a secondary transfer unit.

FIG. 3 is a perspective view of the secondary transfer unit 20. In this embodiment, the secondary transfer roll 21 is rotatably attached to a secondary transfer roll unit 70, while the backup roll 22 is rotatably attached to a backup roll unit 71. Slide frames 83 and 84 are slidably attached vertically to transfer belt frames not shown. The slide frames have positioning pins 72, which are engaged in recession areas 73 provided in the secondary transfer roll unit, thereby positioning the secondary transfer roll.

The secondary transfer roll 21 is rotatably attached to rocking arms 74 at both ends thereof. The rocking arms 74 are swingably attached to the secondary transfer roll unit 70, with center at an axis 75. First eccentric cams 76 and 77 are respectively disposed below tips 74*a* of the rocking arms 74. The first eccentric cams 76 and 77 are fixedly attached to a rotation shaft 78 and driven into rotation by a drive gear 79 provided at an end of the rotation shaft 78. The rotation shaft 78 is attached with an encoder 80 for detecting reference positions and rotation amounts of the first eccentric cams 76 and 77. The rocking arms 74 are energized so that their tips 74*a* are pressed against the first eccentric cams 76 and 77 by coil springs 81 provided at the side of the rocking arms 74. The secondary transfer roll 21 rotates the first eccentric cams 76 and 77 to change angles of the rocking arms 74 pressed against the first eccentric cams 76 and 77, whereby the secondary transfer roll 21 can move horizontally while contacting or separating from the backup roll 22.

On the other hand, at both ends of the backup roll 22 are provided backup roll holders (not shown) rotatably supporting the backup roll 22, which is screwed to a cuboid backup roll housing 82 having an open lower end face.

A front slide frame 83 and a rear slide flame 84 are slidably attached vertically to transfer belt frames not shown. The transfer belt frames not shown are provided with bearings (not shown) having open long holes in which pins 85 projectingly disposed in the outside faces of the slide frames 83 and 84 are attached. The slide frames 83 and 84 are vertically movable independently between the front side and the rear side along the long holes (not shown) of the bearings. Pins 86 are projectingly disposed in the upper ends of the slide frames 83 and 84. Bearings 87 are rotatably fixed to the pins 86.

Second eccentric cams 88 and 89 are disposed above the front and rear slide frames 83 and 84, and fixed to a rotation shaft 90. The rotation shaft 90 is rotatably attached penetratingly to the transfer belt frames not shown. The rotation shaft 90 is driven into rotation, through a gear 91 attached to the rotation shaft 90, by a drive motor (transfer nip width adjustment motor) 111 having a drive gear 92 engaging with the gear 91. The rotation shaft 90 is attached with an encoder 93 for detecting reference positions and rotation amounts of the second eccentric cams 88 and 89. The slide frames 83 and 84 are upward energized by coil springs 94 attached to upper ends thereof, and the second eccentric cams 88 and 89 are pressed against the bearings 87 attached to the slide frames 83 and 84. Rotating the second eccentric cams 88 and 89 by the drive motor 111 enables the front and rear slide frames 83 and 84 to move on the transfer belt frames not shown.

The second eccentric cams 88 and 89, which are of identical type and 180 degrees out of phase with each other, are respectively attached inside and outside. In other words, the second eccentric cams 88 and 89 are constructed to move slantingly in directions opposite to each other in both ends thereof by the width of the long hole bearing between the transfer belt frames not shown, with their center as axis. In short, if the out side (the slide frame 83 side) moves upward, the in side (the slide frame 84 side) moves downward.

The secondary transfer roll 21, the backup roll 22, and the rotation shaft 90 of the second eccentric cams 88 and 89 are disposed so that their centers are on a substantially straight line L. Transfer nip shapes change as the secondary transfer roll 21 moves in line with vertical movement of the slide frames. Thereby, in transfer nip, speed differences can be produced in the out side and the in side.

Figure 4:
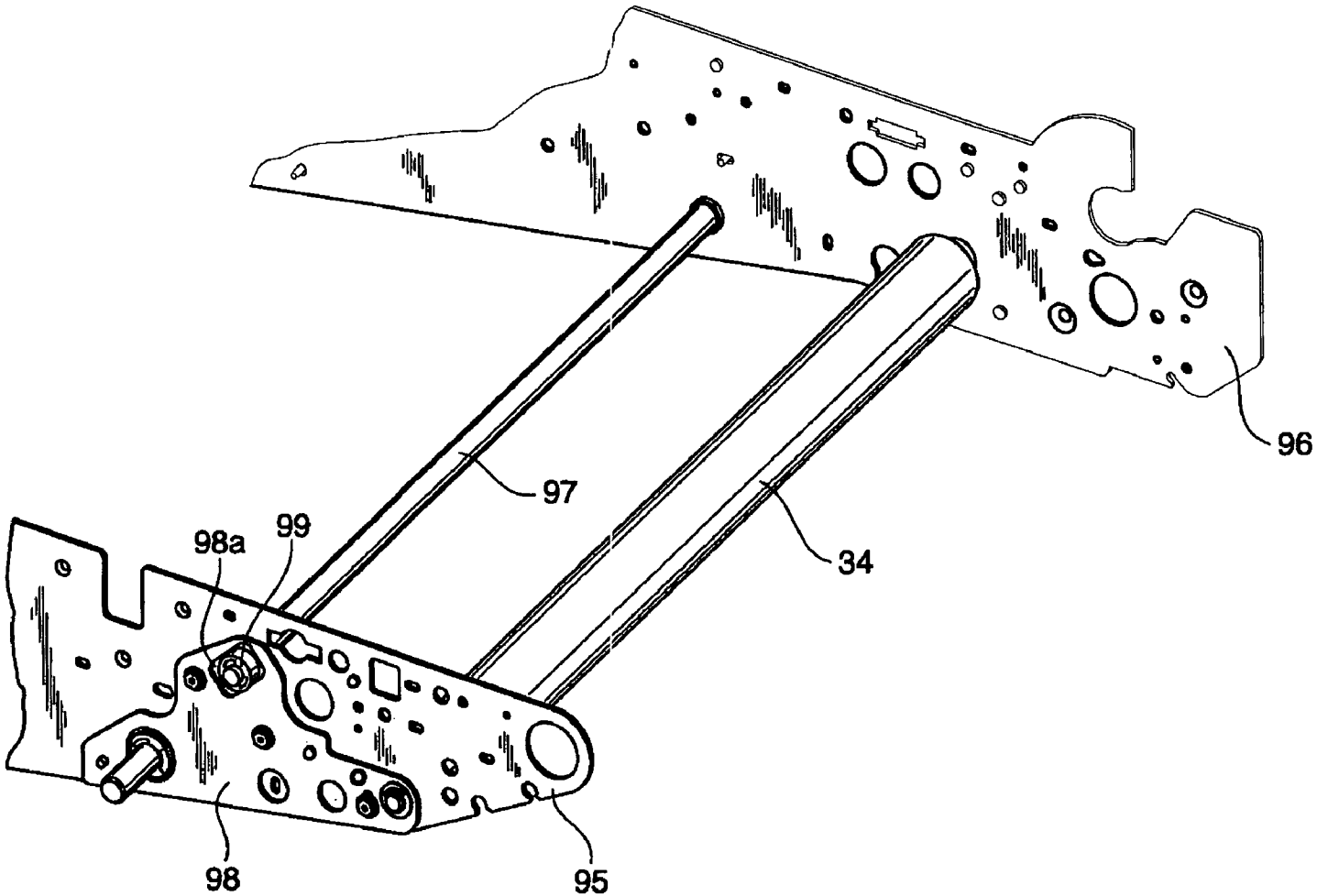
FIG. 4 is a perspective view showing an idle roll.

FIG. 4 is a perspective view of the idle roll 34 provided in the downstream side of the transportation direction of the intermediate transfer belt 15 with respect to the secondary transfer unit 20. In this embodiment, the idle roll 34 is rotatably attached to a front frame 95 and a rear frame 96. In this embodiment, one end of the idle roll 34 is attached to a holding plate 98 swingably attached to the shaft 97 rotatably and penetratingly attached to the front frame 95 and the rear frame 96. A rectangular opening 98*a* is formed in an upper portion of the holding plate 98, and a cam 99 rotatably attached to the front frame 95 is disposed in the opening 98*a*. The cam 99 is driven into rotation by a drive motor (belt displacement motor) 114 (see FIG. 6 described later).

Figure 5:
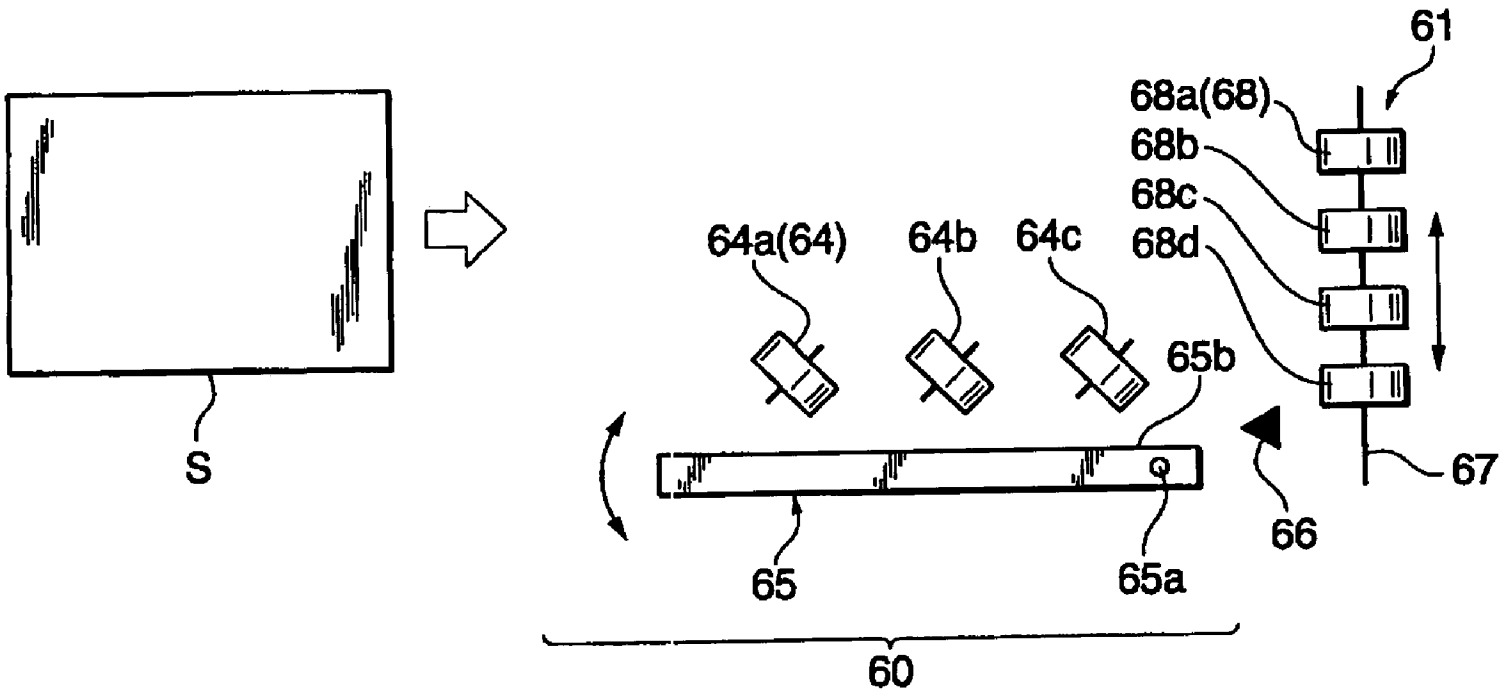
FIG. 5 is a top view of a posture correction unit and a registration roll.

FIG. 5 is a top view of the posture correction unit 60 and the registration roll 61. The posture correction unit 60 is provided with three skew rolls 64 (64*a*, 64*b*, 64*c*) from the upstream side to the downstream side in the transportation direction of sheet S. The skew rolls 64 are respectively disposed with an inclination of predetermined angles to the transportation direction of sheet S, and paired with lower rolls not shown (sec FIG. 2). At the right side (a lower portion of the drawing) of the skew rolls 64 is provided a side guide 65 along the sheet transportation direction. Although the side guide 65 is basically disposed in parallel with the sheet transportation direction, it is swingably attached, with center at an axis 65*a* provided in the downstream side of the sheet transportation direction. The side guide 65 is driven (rocked) by a side guide drive motor 115 (see FIG. 6 described later) attached to the axis 65*a*. The transported sheet S is transported in an inclined direction by the skew rolls 64 and its side end collides with a collision face 65*b* of the side guide 65, where a posture of the sheet S is corrected. Therefore, postures of the sheet S change depending on inclinations of the side guide 65.

In the downstream direction of the sheet transportation direction with respect to the side guide 65, a sheet side end detection sensor 66 is provided inside a transportation path that is several millimeters on an extension of the collision face 65*b*. The sheet side end detection sensor 66, which detects the side end of sheet S transported, is constituted of an optical sensor or the like including a combination of, e.g., light-emitting devices and light-receiving devices.

The registration roll 61 disposed in the downstream direction of the sheet transportation direction with respect to the skew rolls 64 includes a rotatable shaft 67 movably disposed in a direction orthogonal to the sheet transportation direction and four rolls 68 (68*a* to 68*d*) attached to the shaft 67. The shaft 67 of the registration roll 61 is attached with a registration roll drive motor 116 (see FIG. 6 described later) for rotating the registration roll 61 and a side shift motor 117 (see FIG. 6 described later) for moving the registration roll 61 in an axial direction.

Figure 6:
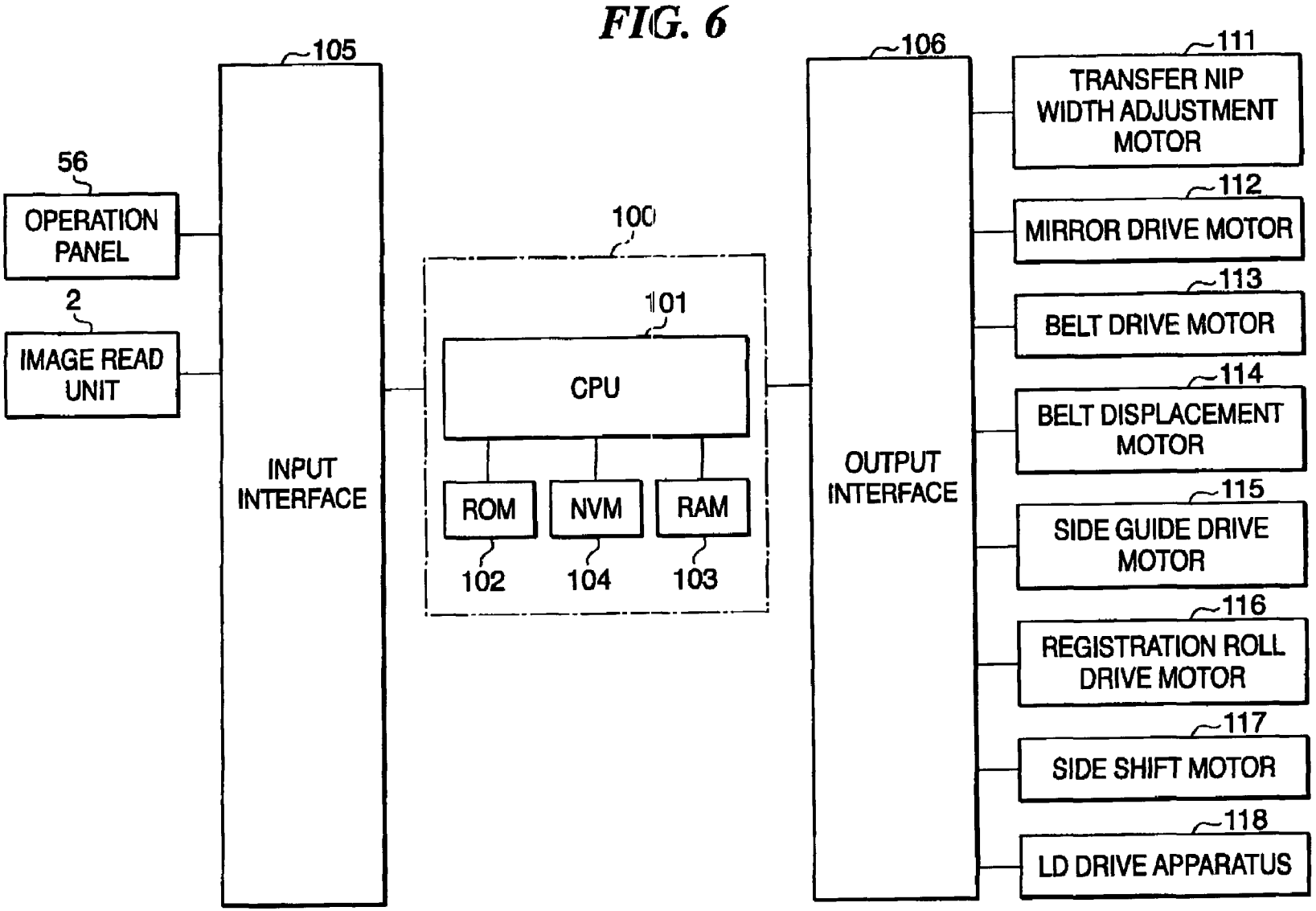
FIG. 6 is a blocking diagram showing a setting unit.

FIG. 6 is a blocking diagram showing a setting unit 100 that performs various alignment settings and timing settings in the image forming apparatus of this embodiment. The setting unit 100 constitutes one function of the control unit 40. A CPU 101 of the setting unit 100 performs processing through required data operations with a RAM 103 according to a program stored in a ROM 102. The CPU 101 is attached with NVM (nonvolatile memory) 104, which is a sort of nonvolatile memory, to store data as required. The setting unit 100 is supplied through the input interface 105 with an alignment setting request and sheet information such as the type of sheet used, basis weight, and size from the operation panel 56, and image information of a test pattern read from the image read unit 2. The setting unit 100 controls through an output interface 106: a transfer nip width adjustment motor 111 of the secondary transfer unit 20 (see FIG. 2); mirror drive motors 112 of the laser exposing units 13 (see FIG. 2); a belt drive motor 113 driving the intermediate transfer belt 15 (see FIG. 2); a belt displacement motor 114 displacing the idle roll 34 stretching the intermediate transfer belt 15 (see FIG. 2); a side guide drive motor 115 rocking the side guide 65 (see FIG. 5) of the posture correction unit 60; a registration roll drive motor 116 for driving the registration roll 61 (see FIG. 5) into rotation; a side shift motor 117 for moving the registration roll 61 (see FIG. 5) in an axial direction; and an LD drive apparatus 118 attached to the laser diode 13*a*.

Next, a description will be made of adjustment operation in the full-color image forming apparatus 1. A program controlling the CPU 101 of the setting unit 100 to achieve functions described below is stored in the ROM 102, or it is read into the RAM 103 after distribution in a form stored in magnetic disk, optical disk, semiconductor memory, or other storage media, or through network. Data and a program held in the RAM 103 can be saved to storage apparatuses such as the NVM 104 and a hard disk (not shown).

Figure 7B:
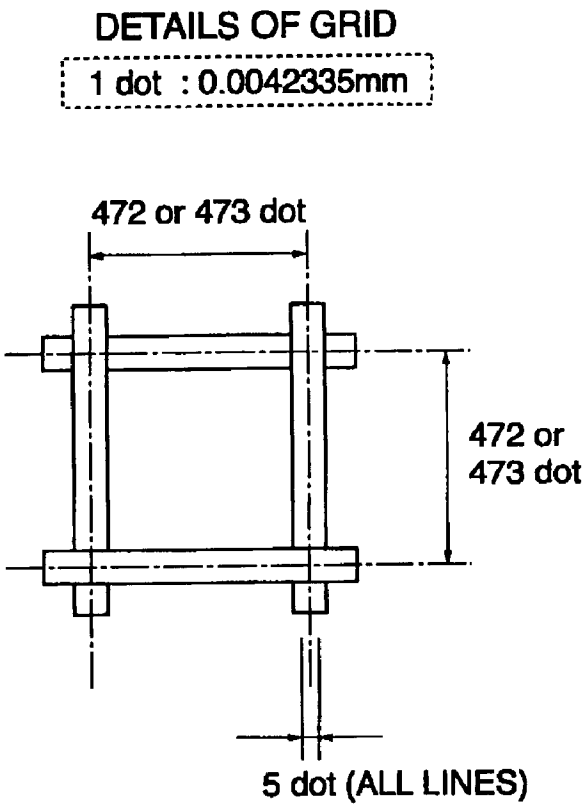
FIG. 7 is a diagram showing a test pattern.
Figure 7A:
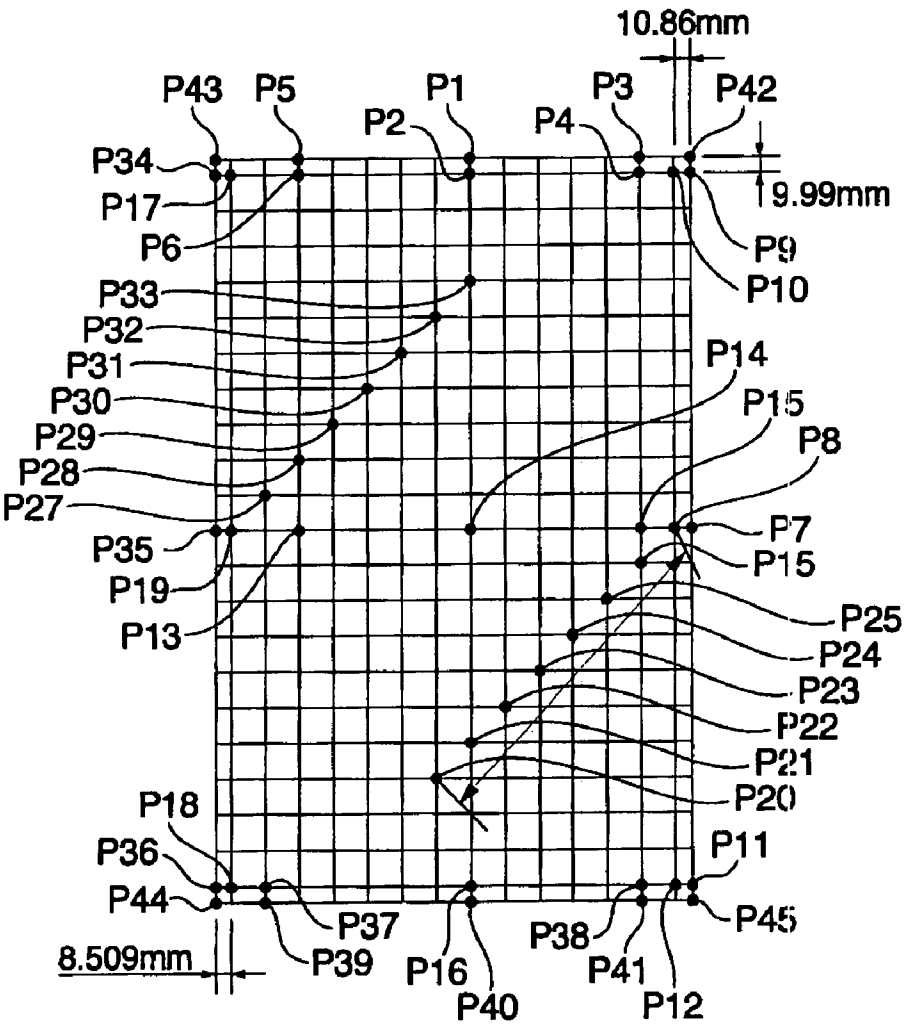

For a user to perform adjustment, the user makes a request for adjustments through the UI from the operation panel 56. A test pattern shown in FIG. 7 is formed on sheet S, using the full-color image forming apparatus 1. The test pattern includes a large number of grids shown to the right of the drawing formed by arranging linear line images vertically and horizontally. Points P1 to P45 in which vertical and horizontal lines cross indicate points used in the adjustment operation. The points P1 to P4 include points used in other than adjustments described here.

Here, the test pattern is created on the basis of data stored in a storage unit such as ROM. However, it may be created on the basis of data inputted by some input parts or through external communication lines or the like, or may be data temporarily stored in memory. It may be data created on the basis of specific computation expressions by the full-color image forming apparatus 1. The pattern and data may be freely changed by the user or other managers.

In the test pattern, the top (point P1 side) of the drawing is formed in the leading edge of sheet S and the bottom (point P40 side) of the drawing is formed in the trailing edge of the sheet S. The test pattern is created on the surface and back of the sheet S. This example shows a test pattern when a sheet S of 11 inches by 17 inches is used.

Figure 8:
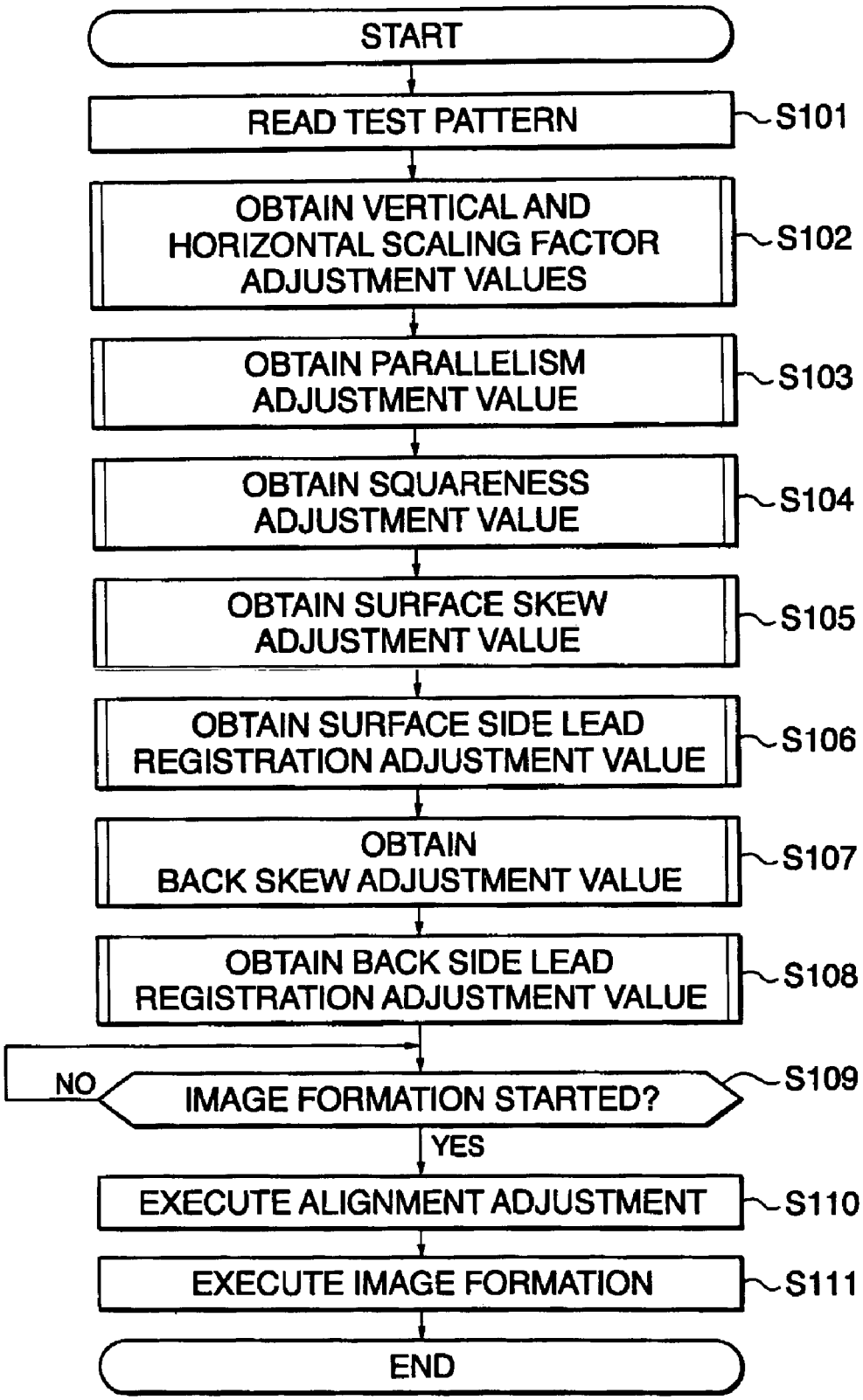
FIG. 8 is a flowchart for explaining adjustments.

FIG. 8 shows a flowchart for adjusting the full-color image forming apparatus 1 on the basis of the test pattern on the sheet S. The sheet S on which the test pattern is formed is set on the image read unit 2 and the test pattern is read (step S101). The test pattern is read from each of the both sides of the sheet S.

Adjustment values of vertical and horizontal scaling factors are obtained (step S102). A vertical scaling factor is a scale indicating degrees of expansion and contraction of images (toner images) in a transportation direction of the sheet 5, and a horizontal scaling factor is a scale indicating degrees of expansion and contraction of images (toner images) in a direction orthogonal to a transportation direction of the sheet S. In this embodiment, vertical scaling factors are adjusted by adjusting speeds of the belt drive motor 113 driving the intermediate transfer belt 15 through the drive roll 31. Horizontal scaling factors are adjusted by changing write frequencies of the laser diodes 13*a* of the laser exposing units 13 by the LD drive apparatus 118. Therefore, a vertical scaling factor adjustment value is used as a drive parameter of the belt drive motor 113 and a horizontal scaling factor adjustment value is used as a drive parameter of the LD drive apparatus 118.

An adjustment value of parallelism is obtained (step S103). The parallelism is a scale indicating whether images can be drawn in parallel to a transportation direction of the sheet S. In this embodiment, the parallelism is adjusted by changing a nip pressure distribution of the secondary transfer roll 21 and the backup roll 22 in the secondary transfer unit 20 by the transfer nip width adjustment motor 111. Therefore, a parallelism adjustment value is used as a drive parameter of the transfer nip width adjustment motor 111.

An adjustment value of squareness is obtained (step S104). The squareness is a scale indicating whether images can be drawn in a direction orthogonal to a transportation direction of the sheet S. In this embodiment, the squareness is adjusted by changing mounting angles of the skew mirrors 13*f* in the laser exposing units 13 by the minor drive motor 112 and displacing the idle motor 34 stretching the intermediate transfer belt 15 by the belt displacement motor 114. However, main processing is to adjust mounting angles of the skew minors 13f displacement of the idle motor 34 is used as secondarily adjustment technique. Therefore, a squareness adjustment value is used as a drive parameter of the minor drive motor 112, and in some cases, as a drive parameter of the belt displacement motor 114.

An adjustment value of surface skew is obtained (step S105). The surface skew is a scale indicating whether the sheet S on the surface of which an image is to be formed is skew with respect to a transportation direction of the sheet S. In this embodiment, the surface skew is adjusted by changing mounting angles of the side guide 65 of the posture correction unit 60 by the side guide drive motor 115. Therefore, a surface skew adjustment value is used as a drive parameter of the side guide drive motor 115.

An adjustment value of surface side/lead registration is obtained (step S106). The surface side registration is a scale indicating whether the sheet S on the surface of which an image is to be formed is skew to one end thereof (right or left with respect to the transportation direction of the sheet 5) with respect to a direction orthogonal to the transportation direction of the sheet S. The surface lead registration is a scale indicating whether the sheet S on the surface of which an image is to be formed is skew to one end thereof (front or back with respect to the transportation direction of the sheet 5) with respect to the transportation direction of the sheet S. In this embodiment, the surface lead registration is adjusted by changing the timing (timing of feeding the sheet S to the secondary transfer unit 20) for staring the rotation of the registration roll 61 or adjusting its speed by the registration roll drive motor 116. The surface side registration is adjusted by changing the amount of movement of the registration roll 61 in an axial direction by the side shift motor 117. Therefore, a surface lead registration adjustment value is used as a drive parameter of the registration roll drive motor 116, and a surface side registration adjustment value is used as a drive parameter of the side shift motor 117.

Upon termination of the adjustment of surface side/lead registration, an adjustment value of back skew is obtained (step S107). The back skew, like the above-described surface skew, is a scale indicating whether the sheet S on the back of which an image is to be formed is skew with respect to a transportation direction of the sheet S. In this embodiment, the back skew is adjusted by changing mounting angles of the side guide 65 of the posture correction unit 60 by the side guide drive motor 115. Therefore, a back skew adjustment value is used as a drive parameter of the side guide drive motor 115.

An adjustment value of back side/lead registration is obtained (step S108). The back side registration, like the above-described surface side registration, is a scale indicating whether the sheet S on the back of which an image is to be formed is skew to one end thereof (right or left with respect to the transportation direction of the sheet S) with respect to a direction orthogonal to the transportation direction of the sheet S. The back lead registration, like the above-described surface lead registration, is a scale indicating whether the sheet S on the back of which an image is to be formed is skew to one end thereof (front or back with respect to the transportation direction of the sheet 5) with respect to the transportation direction of the sheet S. In this embodiment, the back lead registration is adjusted by changing timing (timing of feeding the sheet S to the secondary transfer unit 20) for staring the rotation of the registration roll 61 or adjusting its speed by the registration roll drive motor 116. The back side registration is adjusted by changing the amount of movement of the registration roll 61 in an axial direction by the side shift motor 117. Therefore, a back lead registration adjustment value is used as a drive parameter of the registration roll drive motor 116, and a back side registration adjustment value is used as a drive parameter of the side shift motor 117.

Whether image formation is to be started is determined (step S109). If image formation is performed, adjustments are made on the basis of the adjustment values obtained in the above-described steps S102 to S108 (step S110). After termination of the adjustments, image formation is performed (step S111) and a series of processing steps terminate. If image formation is not started in step S109, the image forming apparatus waits for start.

Figure 9:
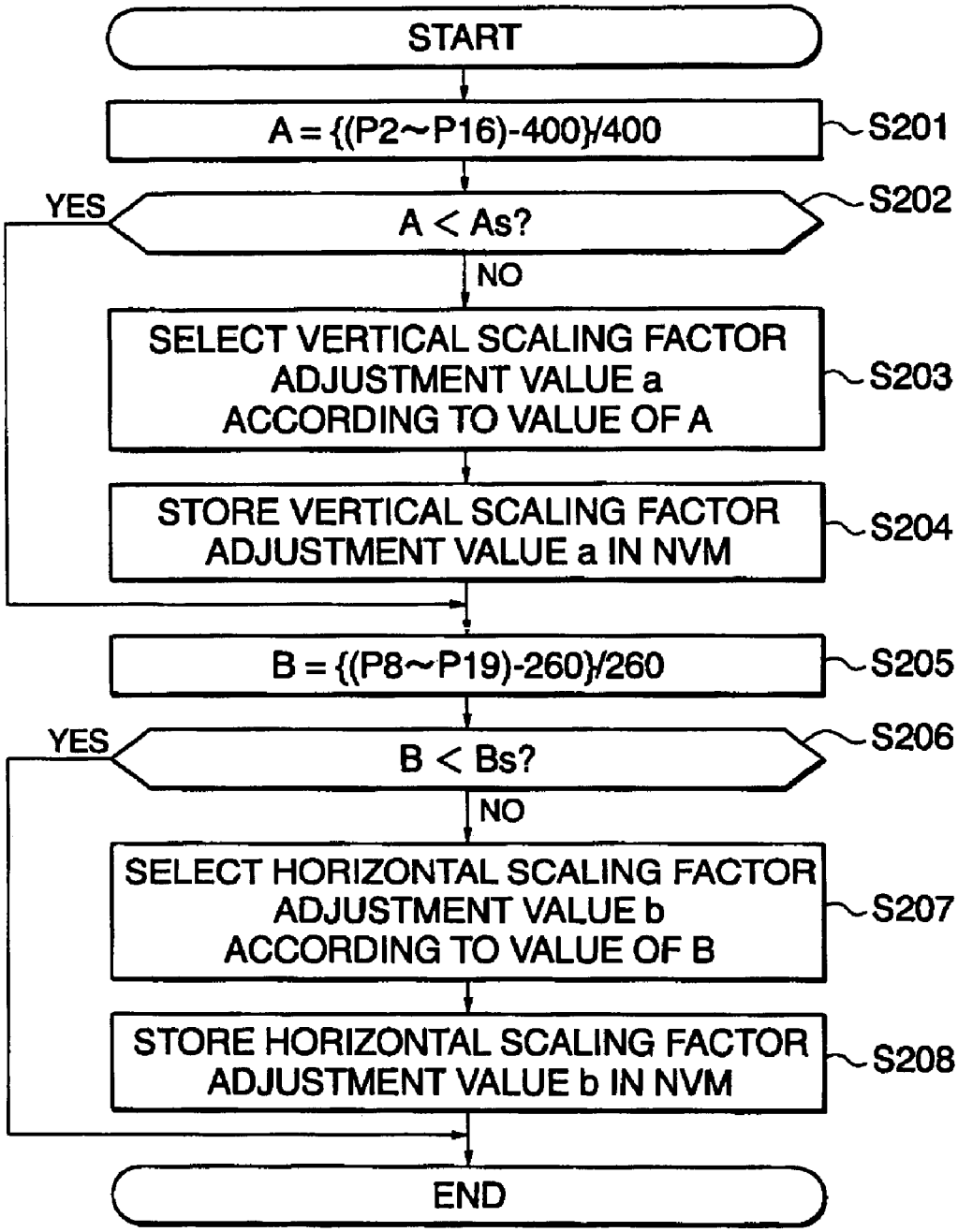
FIG. 9 is a flowchart for obtaining vertical and horizontal scaling factor adjustment values.

The above-described steps S102 to S108 are described in detail. FIG. 9 is a flowchart for obtaining vertical and horizontal scaling factor adjustment values in step S102.

In this processing, the distance (P2~P16) between point P2 and point P16 is determined from the read test pattern (surface), and on the basis of it, a vertical scaling factor misregistration amount A $$A=\{(P2\sim P16)-400\}/400$$

is computed (step S201). The distance (P2~P16) is theoretically 400 mm. Next, it is determined whether the obtained vertical scaling factor misregistration amount A is smaller than a predetermined permissible vertical scaling factor misregistration amount As (step S202). If the vertical scaling factor misregistration amount A is equal to or larger than the permissible vertical scaling factor misregistration amount As, a vertical scaling factor adjustment value a corresponding to the vertical scaling factor misregistration amount A is selected on the basis of a predetermined computation expression (step S203), and the selected vertical scaling factor adjustment value a is stored in the NVM 104 (step S204). On the other hand, if the vertical scaling factor misregistration amount A is smaller than the permissible vertical scaling factor misregistration amount As in step S202, control proceeds to the next step.

The distance (P8~P19) between point P8 and point P19 is determined from the read test pattern (surface), and on the basis of it, a horizontal scaling factor misregistration amount B $$B=\{(P8\sim P19)-260\}/260$$

is computed (step S205). The distance (P8~P19) is theoretically 260 mm. Next, it is determined whether the obtained horizontal scaling factor misregistration amount B is smaller than a predetermined permissible horizontal scaling factor misregistration amount Bs (step S206). If the horizontal scaling factor misregistration amount B is equal to or larger than the permissible horizontal scaling factor misregistration amount Bs, a horizontal scaling factor adjustment value b corresponding to the horizontal scaling factor misregistration amount B is selected on the basis of a predetermined computation expression (step S207), the selected horizontal scaling factor adjustment value b is stored in the NVM 104 (step S208), and processing terminates. On the other hand, if the horizontal scaling factor misregistration amount B is smaller than the permissible horizontal scaling factor misregistration amount Bs in step S206, processing terminates.

Figure 10:
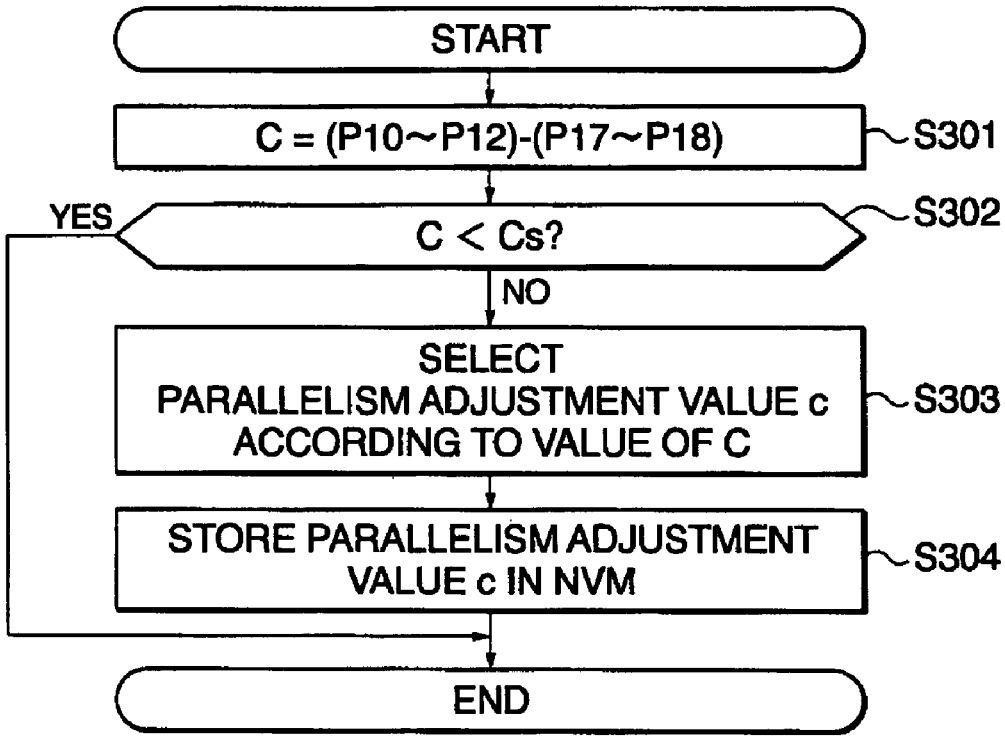
FIG. 10 is a flowchart for obtaining a parallelism adjustment value.

FIG. 10 is a flowchart for obtaining a parallelism adjustment value in step S103.

In this processing, the distance (P10~P12) between point P10 and point P12 and the distance (P17~P18) between point P17 and point P18 are determined from the read test pattern (surface), and on the basis of them, a parallelism misregistration amount C $$C=(P10\sim P12)-(P17\sim P18)$$

is computed (step S301). Next, it is determined whether the obtained parallelism misregistration amount C is smaller than a predetermined permissible parallelism misregistration amount Cs (step S302). If the parallelism misregistration amount C is equal to or larger than the permissible parallelism misregistration amount Cs, a parallelism adjustment value c corresponding to the parallelism misregistration amount C is selected on the basis of a predetermined computation expression (step S303), and the selected parallelism adjustment value c is stored in the NMV 104 (step S304). On the other hand, if the parallelism misregistration amount C is smaller than the permissible parallelism misregistration amount Cs in step, processing terminates.

Figure 11:
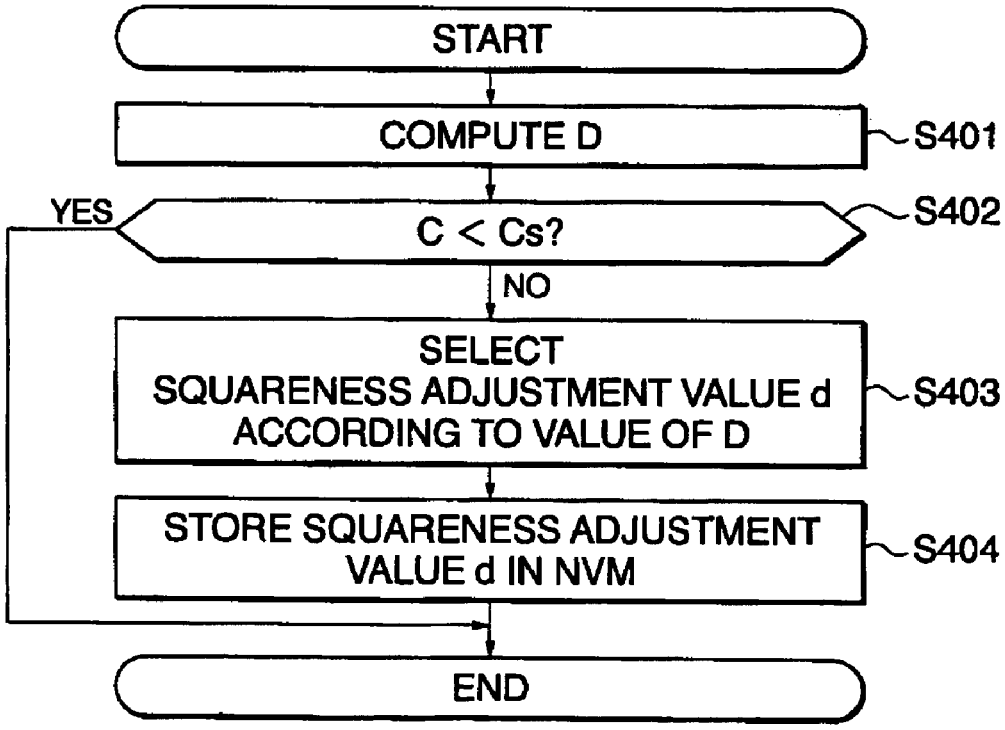
FIG. 11 is a flowchart for obtaining a squareness adjustment value.

FIG. 11 is a flowchart for obtaining a squareness adjustment value in step S104. In this processing, the distance (P6~P4) between point P6 and point P4 and the distance (P2~P16) between point P2 and point P16 are determined from the read test pattern (surface), and on the basis of them, a squareness misregistration amount D (the distance between a perpendicular to a line passing through points P6 and P4 extending perpendicularly from point P2, and point 16) is computed (step S401). Next, it is determined whether the obtained squareness misregistration amount C is smaller than a predetermined permissible squareness misregistration amount Ds (step S402). If the squareness misregistration amount D is equal to or larger than the permissible squareness misregistration amount Ds, a squareness adjustment value d corresponding to the squareness misregistration amount D is selected on the basis of a predetermined computation expression (step S403), and the selected squareness adjustment value d is stored in the NMV 104 (step S404). On the other hand, if the squareness misregistration amount D is smaller than the permissible squareness misregistration amount Ds in step 402, processing terminates.

Figure 12:
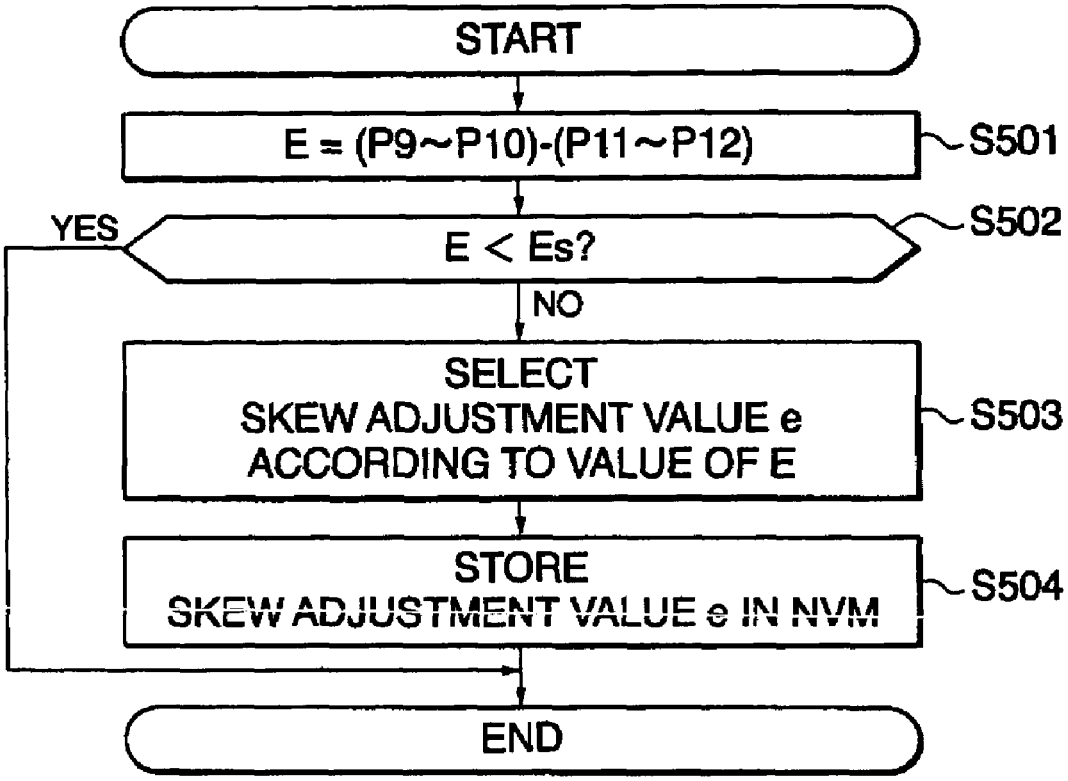
FIG. 12 is a flowchart for obtaining a surface skew adjustment value.

FIG. 12 is a flowchart for obtaining a surface skew adjustment value in step S105.

In this processing, the distance (P9~P10) between point P9 and point P10 and the distance (P11~P12) between point P11 and point P12 are determined from the read test pattern (surface), and on the basis of them, a surface skew misregistration amount E $$E=(P9\sim P10)-(P11\sim P12)$$

is computed (step S501). Next, it is determined whether the obtained surface skew misregistration amount E is smaller than a predetermined permissible surface skew misregistration amount Es (step S502). If the surface skew misregistration amount E is equal to or larger than the permissible surface skew misregistration amount Es, a surface skew adjustment value e corresponding to the surface skew misregistration amount E is selected on the basis of a predetermined computation expression (step S503), and the selected surface skew adjustment value e is stored in the NMV 104 (step S504). On the other hand, if the surface skew misregistration amount E is smaller than the permissible surface skew misregistration amount Es in step S502, processing terminates.

Figure 13:
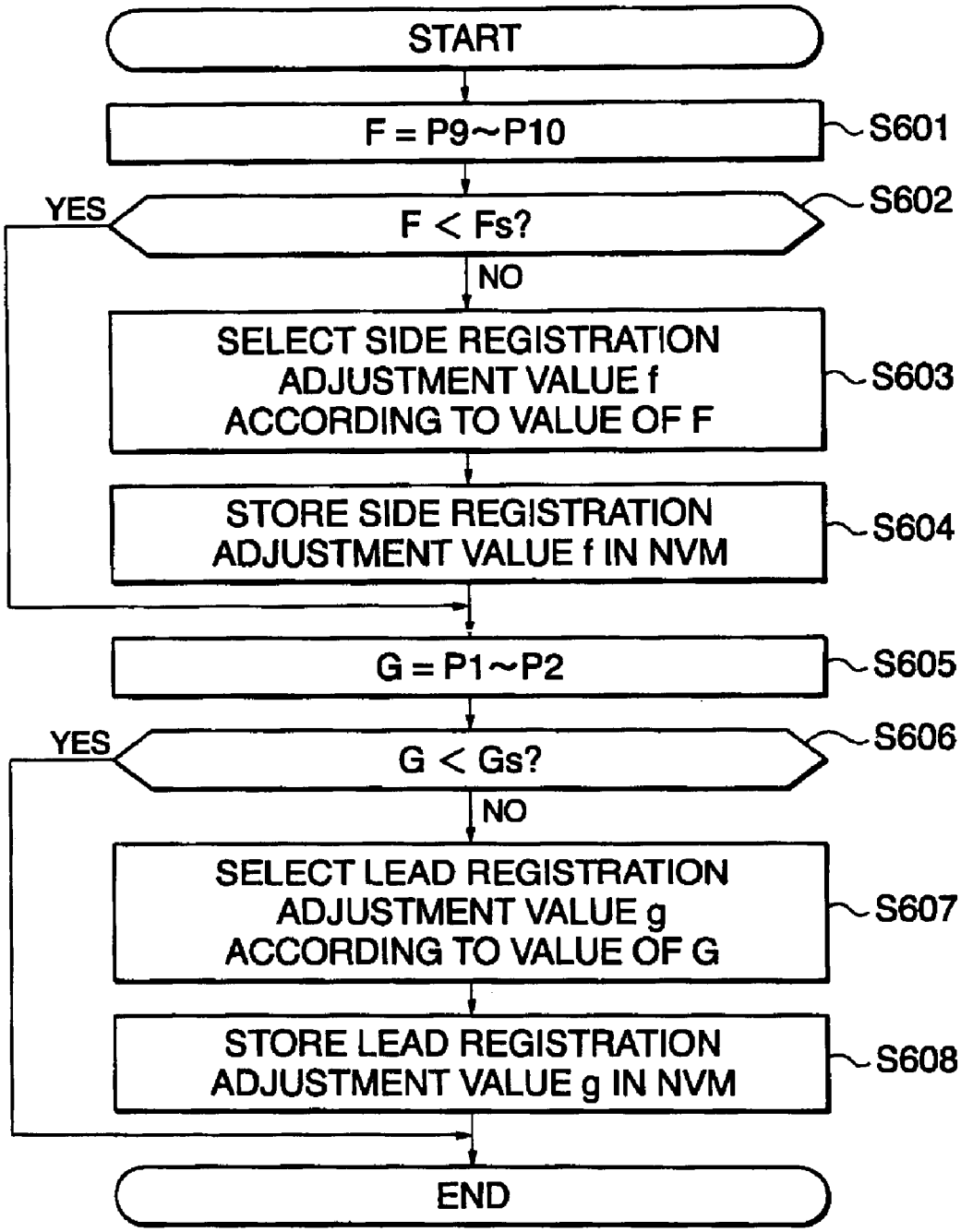
FIG. 13 is a flowchart for obtaining a surface side registration adjustment value and a surface lead registration adjustment value.

FIG. 13 is a flowchart for obtaining a surface side registration adjustment value and a surface lead registration adjustment value in step S106. In this processing, the distance (P9~P10) between point P9 and point P10, that is, a misregistration amount F of a surface side registration is determined from the read test pattern (surface) (step S601):

$$F=(P9\sim P10).$$

Next, it is determined whether the obtained misregistration amount F of the surface side registration is smaller than a predetermined permissible misregistration amount Fs of surface side registration (step S602). If the misregistration amount F of surface side registration is equal to or larger than the permissible misregistration amount Fs of surface side registration, a surface side registration adjustment value f corresponding to the misregistration amount F of surface side registration is selected on the basis of a predetermined computation expression (step S603), and the selected surface side registration adjustment value f is stored in the NMV 104 (step S604). On the other hand, if the misregistration amount F of surface side registration is smaller than the permissible misregistration amount Fs of surface side registration in step S602, control proceeds to the next step.

Next, the distance (P1~P2) between point P1 and point P2, that is, a misregistration amount G of surface lead registration is determined from the read test pattern (surface) (step S605):

$$G=(P1\sim P2).$$

Next, it is determined whether the obtained misregistration amount G of surface lead registration is smaller than a predetermined permissible misregistration amount Gs of surface lead registration (step S606). If the misregistration amount G of surface lead registration is equal to or larger than the permissible misregistration amount Gs of surface lead registration, a surface lead registration adjustment value g corresponding to the misregistration amount G of surface lead registration is selected on the basis of a predetermined computation expression (step S607), the selected surface lead registration adjustment value g is stored in the NMV 104 (step S608), and processing terminates. On the other hand, if the misregistration amount G of surface lead registration is smaller than the permissible misregistration amount Gs of surface lead registration in step S606, processing terminates.

Back skew adjustment in step S107 is made in the same process as the surface skew adjustment shown in FIG. 12, and back side lead registration adjustment in step S108 is made in the same process as the surface side lead registration adjustment shown in FIG. 13. However, in these processes, a test pattern formed on the back of the sheet S is used. In this embodiment, since various adjustment values a to g are obtained in the processes as described above and adjustments (position adjustment, timing adjustment, and speed adjustment) of different constituent members are made, high-precision registration can be made on the side of the user, with the result that high-quality images can be formed. In addition, since adjustments are made only when the misregistration amounts A to G are larger relative to the permissible misregistration amounts As to Gs, frequent execution of adjustments can be avoided.

The above-described steps 102 to 108 are described in detail. FIG. 9 is a flowchart for obtaining vertical and horizontal scaling factor adjustment values in step 102.

In this processing, the distance (P2~P16) between point P2 and point P16 is determined from the read test pattern (surface), and on the basis of it, a vertical scaling factor misregistration amount A $$A=\{(P2\sim P16)-400\}/400$$

is computed (step 201). The distance (P2~P16) is theoretically 400 mm. Next, it is determined whether the obtained vertical scaling factor misregistration amount A is smaller than a predetermined permissible vertical scaling factor misregistration amount As (step 202). If the vertical scaling factor misregistration amount A is equal to or larger than the permissible vertical scaling factor misregistration amount As, a vertical scaling factor adjustment value a corresponding to the vertical scaling factor misregistration amount A is selected on the basis of a predetermined computation expression (step 203), and the selected vertical scaling factor adjustment value a is stored in the NVM 104 (step 204). On the other hand, if the vertical scaling factor misregistration amount A is smaller than the permissible vertical scaling factor misregistration amount As in step 202, control proceeds to the next step.

The distance (P8~P19) between point P8 and point P19 is determined from the read test pattern (surface), and on the basis of it, a horizontal scaling factor misregistration amount B $$B=\{(P8\sim P19)-260\}/260$$

is computed (step 205). The distance (P8~P19) is theoretically 260 mm. Next, it is determined whether the obtained horizontal scaling factor misregistration amount B is smaller than a predetermined permissible horizontal scaling factor misregistration amount Bs (step 206). If the horizontal scaling factor misregistration amount B is equal to or larger than the permissible horizontal scaling factor misregistration amount Bs, a horizontal scaling factor adjustment value b corresponding to the horizontal scaling factor misregistration amount B is selected on the basis of a predetermined computation expression (step 207), the selected horizontal scaling factor adjustment value b is stored in the NVM 104 (step 208), and processing terminates. On the other hand, if the horizontal scaling factor misregistration amount B is smaller than the permissible horizontal scaling factor misregistration amount Bs in step 206, processing terminates.

FIG. 10 is a flowchart for obtaining a parallelism adjustment value in step S103.

In this processing, the distance (P10~P12) between point P10 and point P12 and the distance (P17~P18) between point P17 and point P18 are determined from the read test pattern (surface), and on the basis of them, a parallelism misregistration amount C $$C=(P10\sim P12)-(P17\sim P18)$$

is computed (step S301). Next, it is determined whether the obtained parallelism misregistration amount C is smaller than a predetermined permissible parallelism misregistration amount Cs (step S302). If the parallelism misregistration amount C is equal to or larger than the permissible parallelism misregistration amount Cs, a parallelism adjustment value c corresponding to the parallelism misregistration amount C is selected on the basis of a predetermined computation expression (step S303), and the selected parallelism adjustment value c is stored in the NMV 104 (step S304). On the other hand, if the parallelism misregistration amount C is smaller than the permissible parallelism misregistration amount Cs in step S302, processing terminates.

FIG. 11 is a flowchart for obtaining a squareness adjustment value in step S104. In this processing, the distance (P6~P4) between point P6 and point P4 and the distance (P2~P16) between point P2 and point P16 are determined from the read test pattern (surface), and on the basis of them, a squareness misregistration amount D (the distance between a perpendicular to a line passing through points P6 and P4 extending perpendicularly from point P2, and point 16) is computed (step S401). Next, it is determined whether the obtained squareness misregistration amount D is smaller than a predetermined permissible squareness misregistration amount Ds (step S402). If the squareness misregistration amount D is equal to or larger than the permissible squareness misregistration amount Ds, a squareness adjustment value d corresponding to the squareness misregistration amount D is selected on the basis of a predetermined computation expression (step S403), and the selected squareness adjustment value d is stored in the NMV 104 (step S404). On the other hand, if the squareness misregistration amount D is smaller than the permissible squareness misregistration amount Ds in step S402, processing terminates.

FIG. 12 is a flowchart for obtaining a surface skew adjustment value in step 105.

In this processing, the distance (P9~P10) between point P9 and point P10 and the distance (P11~P12) between point P11 and point P12 are determined from the read test pattern (surface), and on the basis of them, a surface skew misregistration amount E $$E=(P9\sim P10)-(P11\sim P12)$$

is computed (step 501). Next, it is determined whether the obtained surface skew misregistration amount E is smaller than a predetermined permissible surface skew misregistration amount Es (step 502). If the surface skew misregistration amount E is equal to or larger than the permissible surface skew misregistration amount Es, a surface skew adjustment value e corresponding to the surface skew misregistration amount E is selected on the basis of a predetermined computation expression (step 503), and the selected surface skew adjustment value e is stored in the NMV 104 (step 504). On the other hand, if the surface skew misregistration amount E is smaller than the permissible surface skew misregistration amount Es in step 502, processing terminates.

FIG. 13 is a flowchart for obtaining a surface side registration adjustment value and a surface lead registration adjustment value in step 106. In this processing, the distance (P9~P10) between point P9 and point P10, that is, a misregistration amount F of a surface side registration is determined from the read test pattern (surface) (step 601):

$$F=(P9\sim P10).$$

Next, it is determined whether the obtained misregistration amount F of the surface side registration is smaller than a predetermined permissible misregistration amount Fs of surface side registration (step 602). If the misregistration amount F of surface side registration is equal to or larger than the permissible misregistration amount Fs of surface side registration, a surface side registration adjustment value f corresponding to the misregistration amount F of surface side registration is selected on the basis of a predetermined computation expression (step 603), and the selected surface side registration adjustment value f is stored in the NMV 104 (step 604). On the other hand, if the misregistration amount F of surface side registration is smaller than the permissible misregistration amount Fs of surface side registration in step 602, control proceeds to the next step.

Next, the distance (P1~P2) between point P1 and point P2, that is, a misregistration amount G of surface lead registration is determined from the read test pattern (surface) (step 605):

$$G=(P1\sim P2).$$

Next, it is determined whether the obtained misregistration amount G of surface lead registration is smaller than a predetermined permissible misregistration amount Gs of surface lead registration (step 606). If the misregistration amount G of surface lead registration is equal to or larger than the permissible misregistration amount Gs of surface lead registration, a surface lead registration adjustment value g corresponding to the misregistration amount G of surface lead registration is selected on the basis of a predetermined computation expression (step 607), the selected surface lead registration adjustment value g is stored in the NMV 104 (step 608), and processing terminates. On the other hand, if the misregistration amount G of surface lead registration is smaller than the permissible misregistration amount Gs of surface lead registration in step 606, processing terminates.

Back skew adjustment in step 107 is made in the same process as the surface skew adjustment shown in FIG. 12, and back side lead registration adjustment in step 108 is made in the same process as the surface side lead registration adjustment shown in FIG. 13. However, in these processes, a test pattern formed on the back of the sheet S is used.

In this embodiment, since various adjustment values a to g are obtained in the processes as described above and adjustments (position adjustment, timing adjustment, and speed adjustment) of different constituent members are made, high-precision registration can be made on the side of the user, with the result that high-quality images can be formed. In addition, since adjustments are made only when the misregistration amounts A to G are larger relative to the permissible misregistration amounts As to Gs, frequent execution of adjustments can be avoided.

In this embodiment, for each of types of sheet S used, the adjustment values a to g obtained by executing the above-described processes can be stored in the NVM 104. In cases where a given type of sheet S is used, adjustments may be made on the basis of sheet width specified from the operation panel 56 and the adjustment values a to g read from the NVM 104.

Further, even for sheet S of an identical type, optimum image formation conditions change depending on environment conditions (e.g., temperature and humidity). Accordingly, for a sheet S of an identical type, the adjustment values a to g obtained by executing the above-described processes for each of plural environment conditions can be stored in the NVM 104 for each of the environment conditions. In cases where the sheet S is used in a certain type of environment condition, adjustments may be made on the basis of the environment condition specified from the operation panel 56 and the adjustment values a to g read from the NVM 104.

Although, in this embodiment, a description has been made of adjustments made when environments and a sheet type are changed, adjustments can be made by executing the above-described processes also when a constituent member such as the secondary transfer roll 21 is replaced.

Although, in this embodiment, examples of automatically adjusting constituent members have been described, the present invention is not limited to these examples. For example, the user may adjust constituent members by displaying the adjustment values a to g obtained by executing the above-described processes on the operation panel 56 and referring to the displayed adjustment values a to g.

As has been described above, according to the present invention, registration during actual use of the image forming apparatus can be adjusted.

The entire disclosure of Japanese Patent Application No. 2003-060497 filed on Mar. 6, 2003 including specification, claims, drawings and abstract is incorporated herein by reference in its entirety.

What is claimed is:

1. An image forming apparatus comprising:

an image forming part that forms an image on a recording material;

a read part that reads the image formed on the recording material by the image forming part; and an adjusting part that determines an image misregistration value for a plurality of image forming members in the image forming part on the basis of the image data obtained by the read part, wherein if the obtained misregistration value is smaller than a predetermined specification value, the adjusting part bypasses process to obtain an adjusting value for a use condition of the corresponding image forming member, and if the obtained misregistration value is equal to or larger than a predetermined specification value, the adjusting part proceeds process to obtain the adjusting value to adjust the use condition of the corresponding image forming member.

2. The image forming apparatus according to claim 1, wherein the adjusting part adjusts the use condition of the corresponding image forming member exerting an influence on at least one of vertical and horizontal scaling factors of the image, parallelism, squareness, lead registration, side registration, and side skew.

3. The image forming apparatus according to claim 1, further comprising a storing part that stores the use condition of the corresponding image forming member used for adjustment by the adjusting part.

4. The image forming apparatus according to claim 3, wherein the storing part stores the use condition of the corresponding image forming member for each type of recording material used.

5. The image forming apparatus according to claim 3, wherein the storing part stores the use condition of the corresponding image forming member for each environment in which a recording material of the same type is used.

6. The image forming apparatus according to claim 1, wherein the image forming part forms images on both sides of the recording material;

the read part reads the images formed on the both sides of the recording material by the image forming part; and the adjusting part adjusts the use condition of the corresponding image forming member used in the image forming part on the basis of the image data read by the read part, for each side of the recording material.

7. The image forming apparatus according to claim 1, wherein the image formed by the image forming part is a test pattern.

8. The image forming apparatus according to claim 7, wherein the test pattern is a grid pattern.

9. An image forming apparatus comprising:

an image forming part that forms an image on a recording material;

a read part that reads the image formed on the recording material by the image forming part;

an adjusting part that determines an image misregistration value for a plurality of image forming members in the image forming part on the basis of the image data obtained by the read part, wherein if the obtained misregistration value is smaller than a predetermined specification value, the adjusting part bypasses process to obtain an adjusting value for a use condition of a corresponding image forming member, and if the obtained misregistration value is equal to or larger than a predetermined specification value, the adjusting part proceeds process to obtain the adjusting value to adjust the use condition of the corresponding image forming member; and an instruction part that provides instruction to adjust the use condition of the corresponding image forming member used in the image forming part on the basis of image data read by the read part.

10. The image forming apparatus according to claim 9, further comprising a display part that displays the instruction to adjust the use condition of the corresponding image forming member provided by the instruction part, wherein on the basis of the adjustment instruction displayed by the display part, the use condition of the corresponding image forming member is adjusted.

11. An image forming method comprising:

forming an image on a recording material;

reading the image formed on the recording material; and adjusting a use condition of a plurality of image forming members used in the image forming step on the basis of image data read in the reading step, wherein the adjusting step determines an image misregistration value for the plurality of image forming members, wherein if the obtained misregistration value is smaller than a predetermined specification value, process to obtain an adjusting value for the use condition of a corresponding image forming member is bypassed, and if the obtained misregistration value is equal to or larger than a predetermined specification value, process to obtain the adjusting value to adjust the use condition of the corresponding image forming member proceeds.

12. The image forming method according to claim 11, wherein the adjusting step adjusts the use condition of the corresponding image forming member exerting an influence on at least one of vertical and horizontal scaling factors of the image, parallelism, squareness, lead registration, side registration, and side skew.

13. An image forming apparatus comprising:

an image forming part that forms an image on a recording material;

a read part that reads the image formed on the recording material by the image forming part; and an adjusting part that determines an image misregistration value for a plurality of image forming members in the image forming part on the basis of image data obtained by the read part, wherein if the obtained misregistration value is smaller than a predetermined specification value, the adjusting part bypasses process to obtain an adjusting value for a use condition of a corresponding image forming member, and if the obtained misregistration value is equal to or larger than a predetermined specification value, the adjusting part proceeds process to obtain the adjusting value to adjust the use condition of the corresponding image forming member that exerts an influence on at least one of vertical and horizontal scaling factors of an image, parallelism, squareness, lead registration, side registration, and side skew.

14. The image forming apparatus according to claim 13, comprising:

a plurality of image forming members, comprising:

a transfer nip width adjustment motor;

a mirror drive motor of a laser exposing unit;

a belt drive motor that drives an intermediate transfer belt;

a belt displacement motor that displaces an idle roll stretching the intermediate transfer belt;

a side guide drive motor that rocks a side guide of a posture correction section;

a registration roll drive motor that drives a registration roll into rotation;

a side shift motor that moves the registration roll in an axial direction; and an LD drive apparatus attached to a laser diode, wherein the adjusting part controls at least one of the transfer nip width adjustment motor, the mirror drive motor, the belt drive motor, the belt displacement motor, the side guide drive motor, the registration roll drive motor, the side shift motor and the LD drive apparatus.

* * * * *